US006164566A

United States Patent [19]

Hui-Chen

[11] Patent Number: 6,164,566

[45] Date of Patent: Dec. 26, 2000

[54] WATER EJECTING STRUCTURE OF PISTOL NOZZLE

[76] Inventor: Chao Hui-Chen, P.O. Box 453, Taichung, Taiwan

[21] Appl. No.: 09/396,512

[22] Filed: Sep. 15, 1999

[51] Int. Cl.[7] ..... B05B 1/12

[52] U.S. Cl. ..... 239/394; 239/383; 239/437; 239/440; 239/444; 239/446; 239/526

[58] Field of Search ..... 239/380, 381, 239/383, 390, 391, 392, 394, 396, 436, 440, 442, 444, 525, 526, 548, 556, 558, 562, 446, 437

[56] References Cited

U.S. PATENT DOCUMENTS

| | | | |
|---|---|---|---|
| 4,190,207 | 2/1980 | Fienhold et al. | 239/381 |
| 4,303,201 | 12/1981 | Elkins et al. | 239/381 |
| 5,467,927 | 11/1995 | Lee | 239/383 |
| 5,598,978 | 2/1997 | Wang | 239/394 |
| 5,772,121 | 6/1998 | Wang | 239/394 |
| 5,873,531 | 2/1999 | Wang | 239/394 |

*Primary Examiner*—Patrick Brinson
*Assistant Examiner*—Steven J. Ganey
*Attorney, Agent, or Firm*—Harrison & Egbert

[57] ABSTRACT

A pistol-type water sprayer having an outer disk body, a pulsating member, an inner disk body, a water distributing disk, and a nozzle seat. The pulsating member, the inner disk body and the water distributing disk are mounted over a tubular member extending rearwardly of the outer disk body. The outer disk body is provided with a plurality of pulsating water outlets, inner water outlets, outer water outlets and outer water blocking members. The nozzle seat is provided with a water tube capable of being in alignment with the various water outlets to enable the nozzle to project water in various ways.

2 Claims, 7 Drawing Sheets

WATER EJECTING STRUCTURE OF PISTOL NOZZLE

FIELD OF THE INVENTION

The present invention relates generally to a pistol-type water sprayers, and more particularly to a multiple passageway projecting structure of the water sprayer.

BACKGROUND OF THE INVENTION

The conventional pistol-type water sprayers are generally provided with a multiple passageway projecting structure structure, which is capable of emitting water in a relatively small area. In order to sprinkle a large area, a number of the conventional pistol-type water sprayers are often needed.

SUMMARY OF THE INVENTION

The primary objective of the present invention is therefore to provide a pistol-type water sprayer with a multiple passageway projecting structure structure capable of sprinkling a large area.

In keeping with the principle of the present invention, the foregoing objective of the present invention is attained by a pistol-type water sprayers comprising a water projecting structure which is provided with a plurality of water outlets of various forms for attaining a multiple passageway projections.

The objective, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
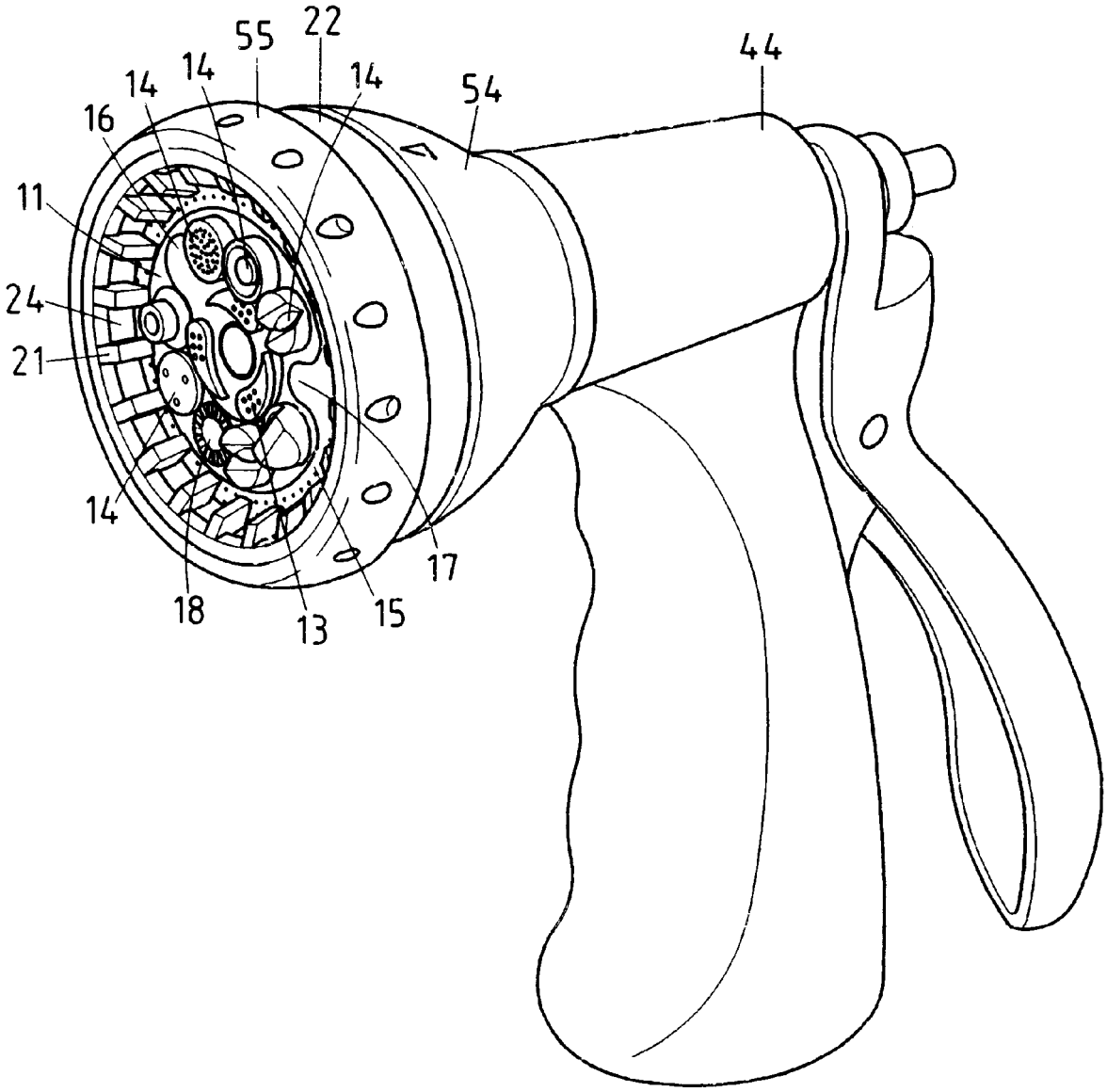
FIG. 1 shows a front perspective view of the present invention.
Figure 2:
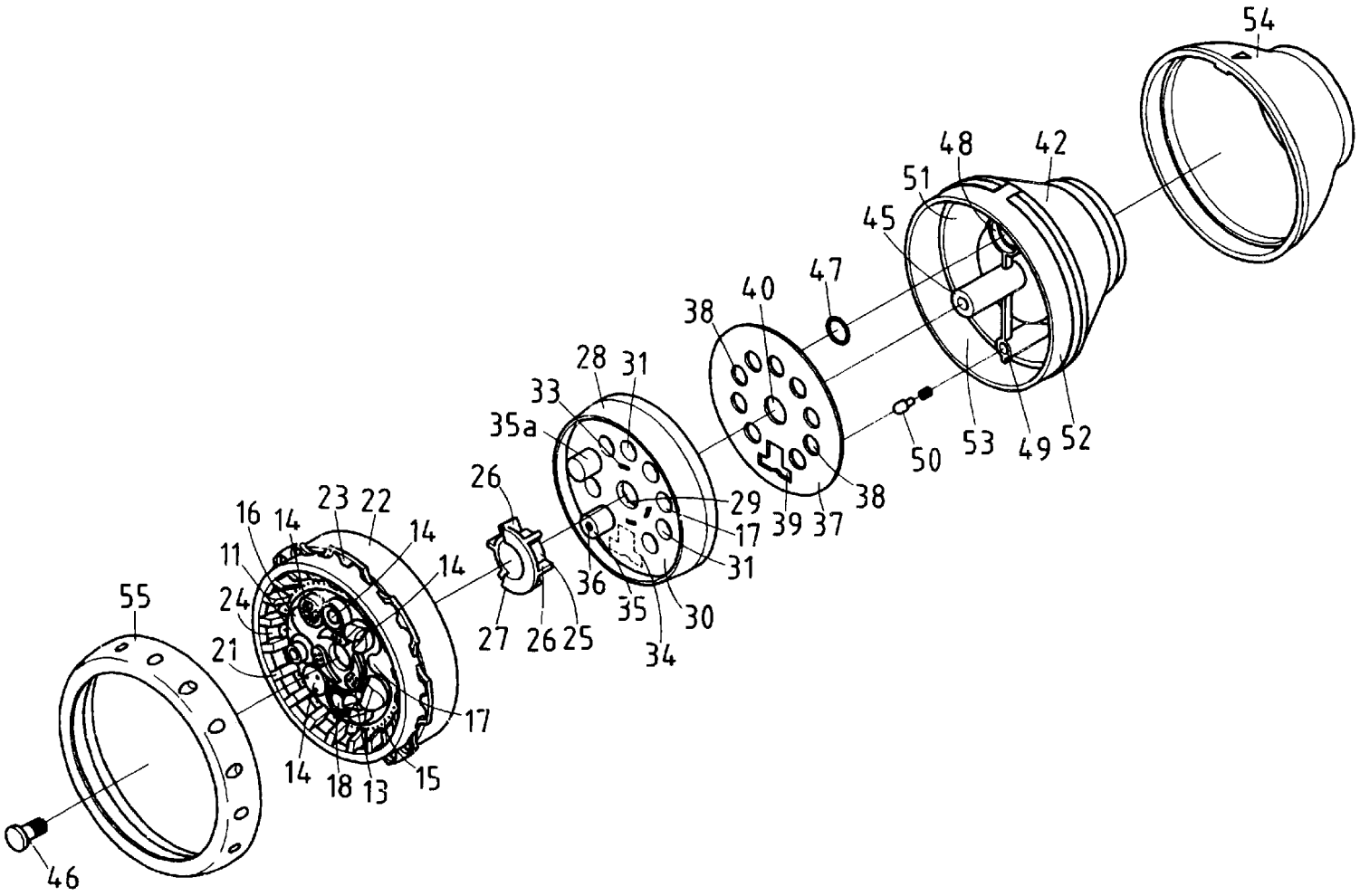
FIG. 2 shows a front exploded view of the present invention.
Figure 3:
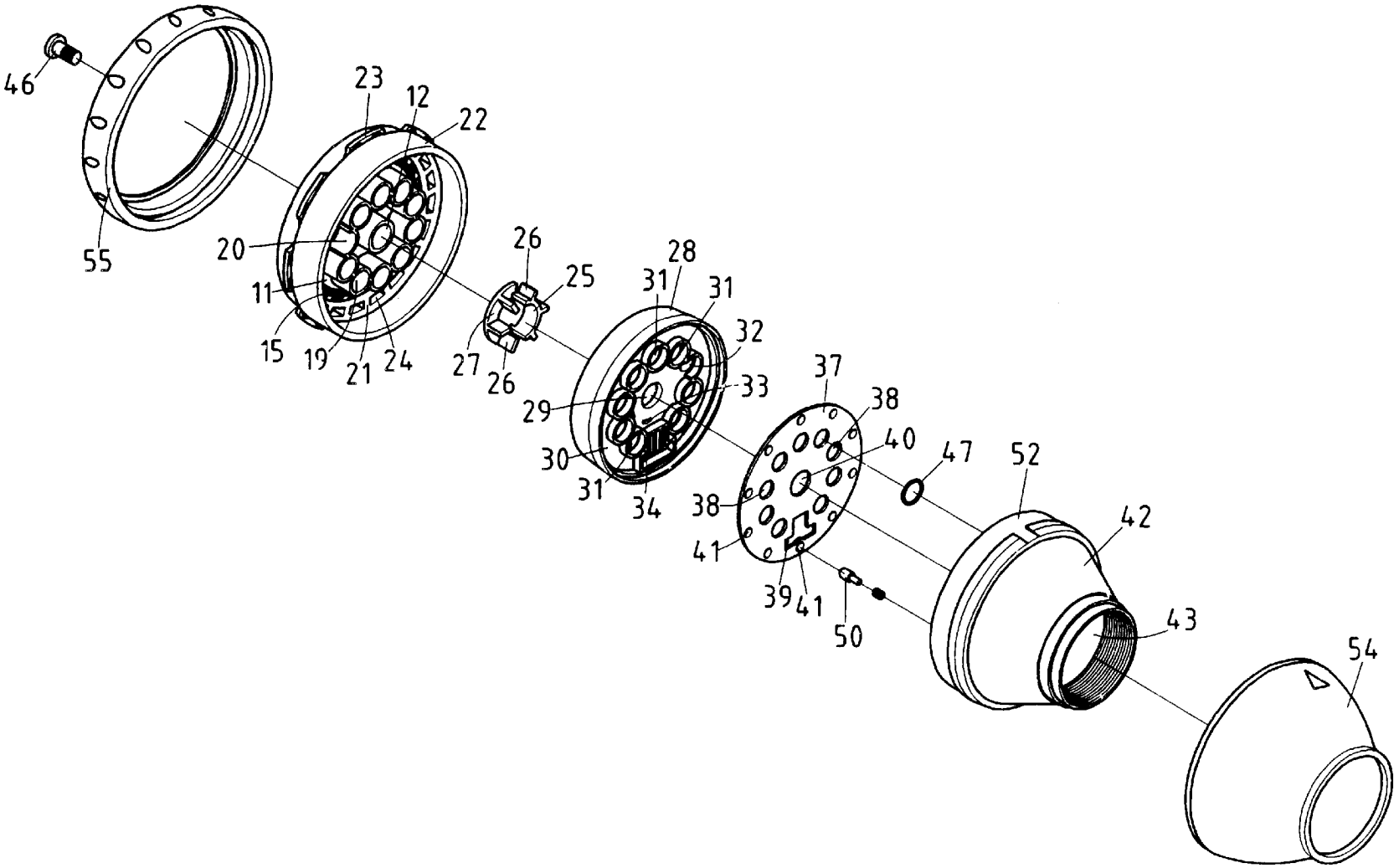
FIG. 3 shows a rear exploded view of the present invention.

As shown in all drawings provided herewith, a pistol-type water sprayers embodied in the present invention comprises an outer disk body 11, a pulsating member 25, an inner disk body 28, a water distributing disk 37, and a nozzle seat 42.

The outer disk body 11 is provided with a tubular member 12 extending rearward from the center thereof, and a plurality of pulsating water outlets 13, inner water outlets 14, outer water outlets 15 and water blocking members 16, 17, and 18. Guide tubes 19 extend rearwardly from the outer disk body 11. One of the guide tubes 19 on the rearward surface of the outer disk body 11 is provided with an indentation 20 which is water flow communication with outer water outlets 15. The outer disk body 11 is further provided with ribs 21 extending therearound which are integrally formed with a control ring 22 having protusions 23. There are a plurality of water passages 24 located between the control ring 22 and the peripery of outer disk body 11.

The pulsating member 25 is provided with a plurality of lobes 26 and a flow stopping plate 27. The pulsating member 25 is rotatable fitted over the tubular member 12 of the outer disk body 11.

The inner disk body 28 is engaged with the outer disk body 11 such that the pulsating member 25 is located between the outer disk body 11 and the inner disk body 28. The inner disk body 28 is provided with a partition 30 which is in turn provided with annular members 31 corresponding in location to the guide tubes 19 of the outer disk body 11, and a mounting hole 29 corresponding in location to the shaft 12 of the outer disk body 11. The inner disk body is provided with a plurality of slanted through holes 33 corresponding in location to each pulsating water outlet 13, and one of the annular members is provided with an indentation 32 which is in water flow communication with the pulsating water outlets 13. The partition 30 is further provided with a frame surface 34. One of the annular members 31 communicates with a sleeve 35 having an opening 36. Sleeve 35 and opening 36 are received within one of the guide tubes 19 corresponding to one of the plurality of inner water outlets 14. A pin member 35*a* extends forwardly from the partition 30. The pin member 35*a* is received within one of the guide tubes 19 corresponding to the outer water blocking member 16.

The water distributing disk 37 is provided with a plurality of through holes 38 arranged in a generally circular pattern, an opening 39, and a fitting hole 40 located at the center of the water distributing disk 37. The water distributing disk 37 is provided in the back side thereof with a plurality of locating recesses 41.

The nozzle seat 42 is provided with a convergence chamber 43 having inner threads which are engaged with a barrel 44 of the pistol-type water sprayer, as shown in FIG. 1. The nozzle seat 42 is further provided with a center pillar 45 having a threaded hole which is engaged with a fastening bolt 46. The nozzle seat 42 is further provided with a water tube 48 which is provided with a washer 47 and is in communication with the convergence chamber 43. The nozzle seat 42 is further provided with a guide tube 49 having an biasing pin 50, and a sealing ring 51 in an intimate contact with the outer peripheral edge of water distributing disk 37. The biasing pin 50 presses against the locating recesses 41 of the water distributing disk 37. The nozzle seat 42 is further provided with a circular extension portion 52, which forms an annular space 53 around the exterior surface of the inner disk body 28.

The nozzle seat 42 is provided with a front shield 55 and a rear shield 54, which are intended for protective and decorative purposes.

Figure 4:
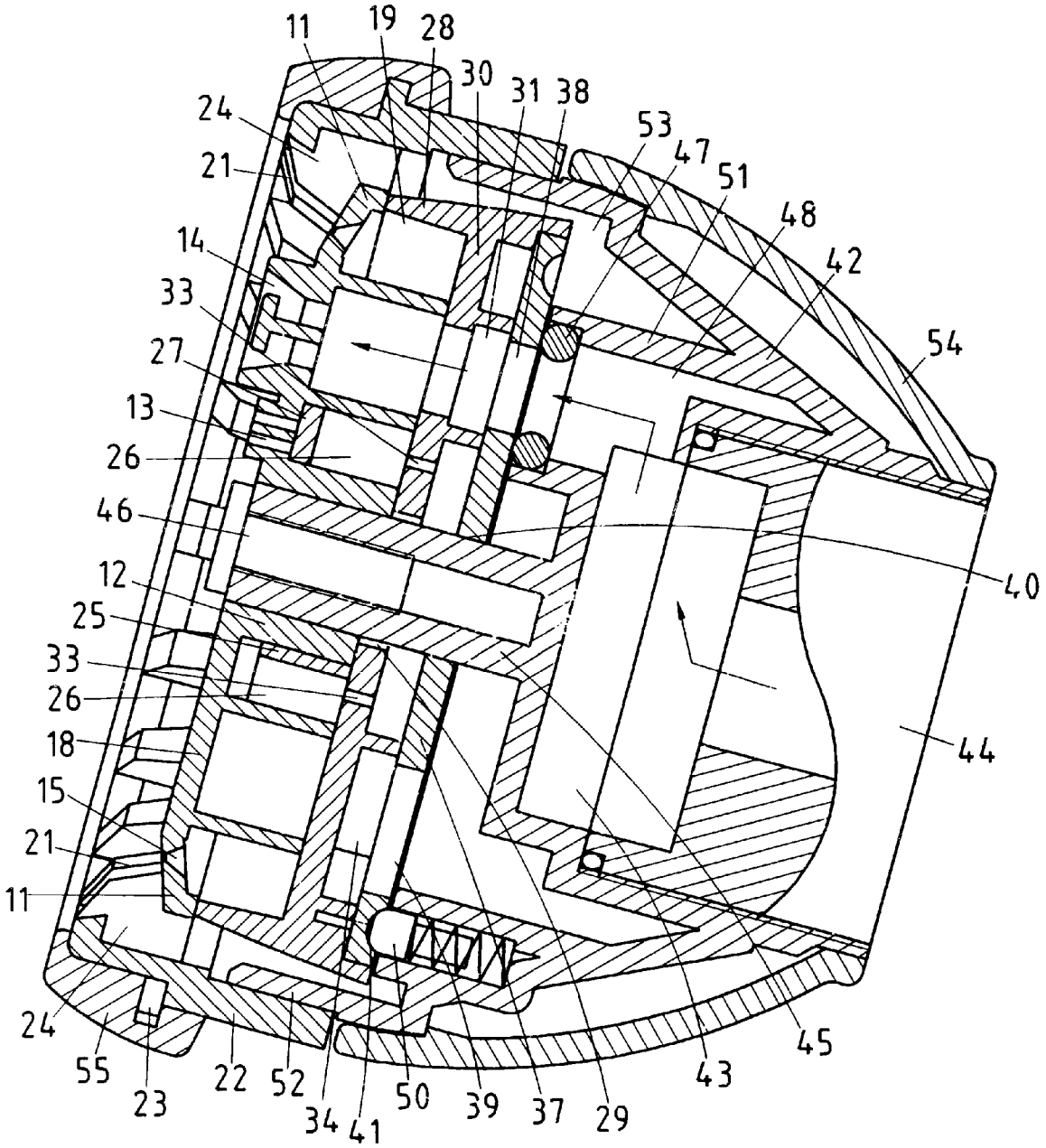
FIG. 4 shows a first sectional view of the present invention in combination.
Figure 5:
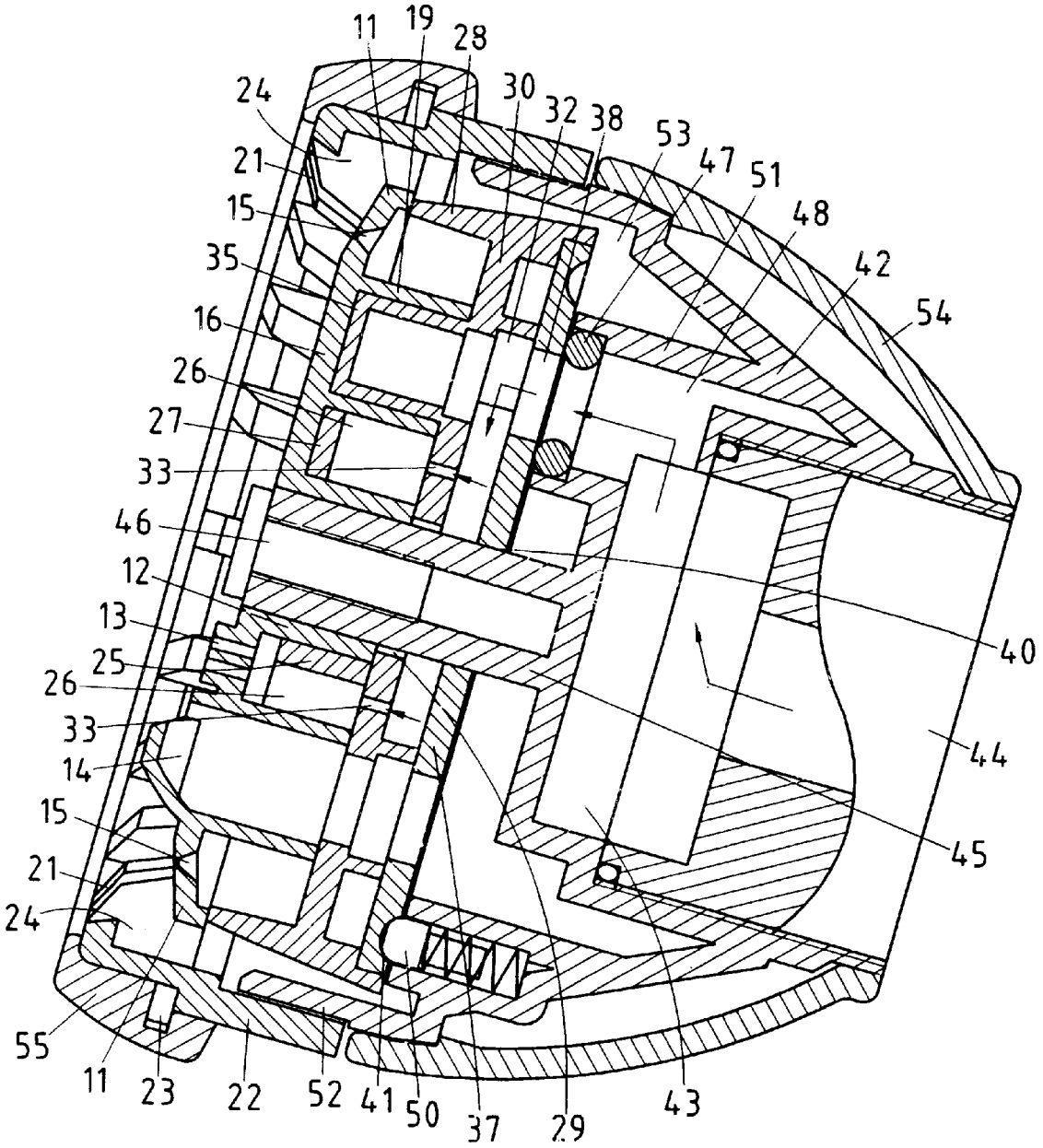
FIG. 5 shows a second sectional view of the present invention in combination.
Figure 6:
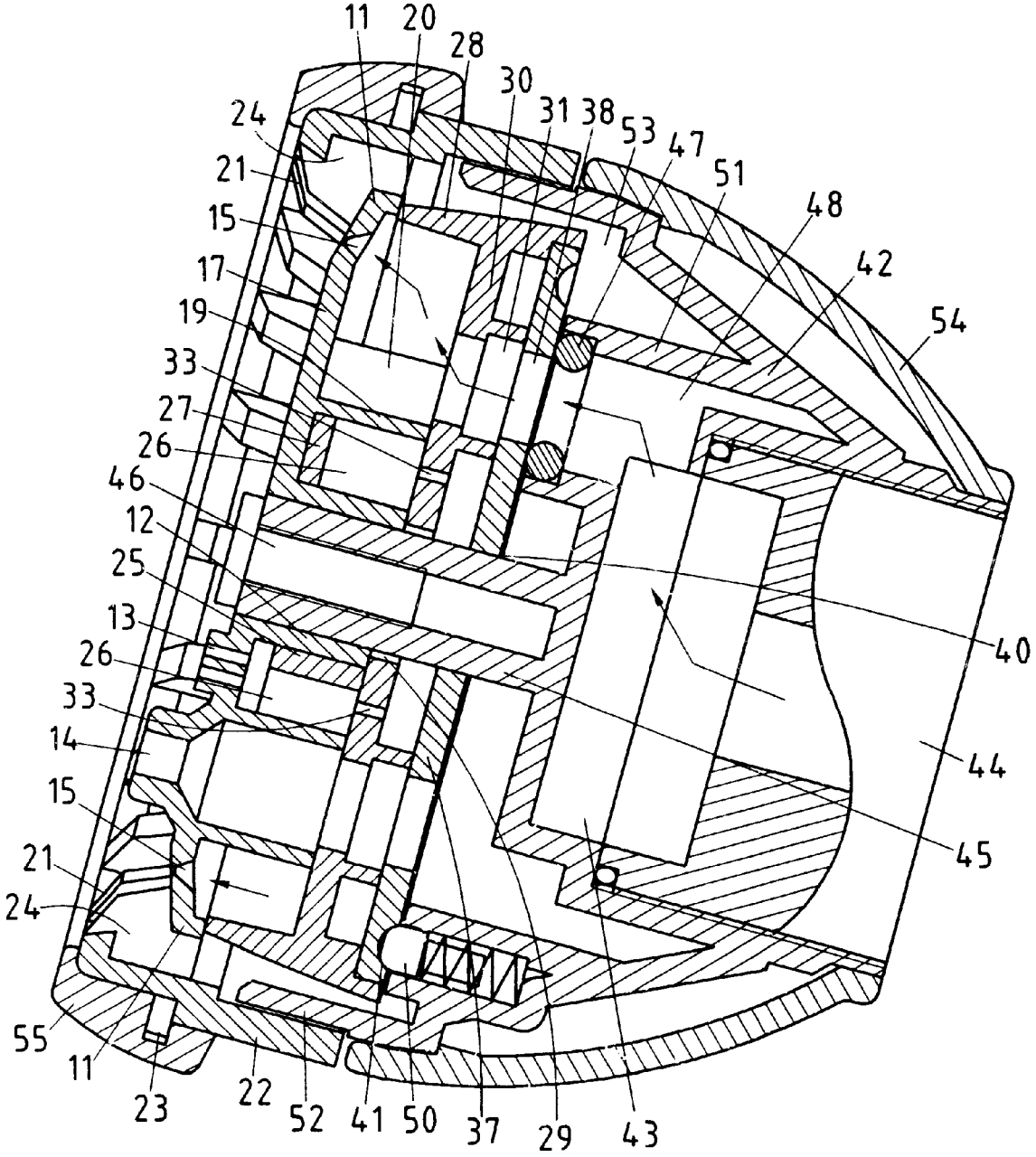
FIG. 6 shows a third sectional view of the present invention.
Figure 7:
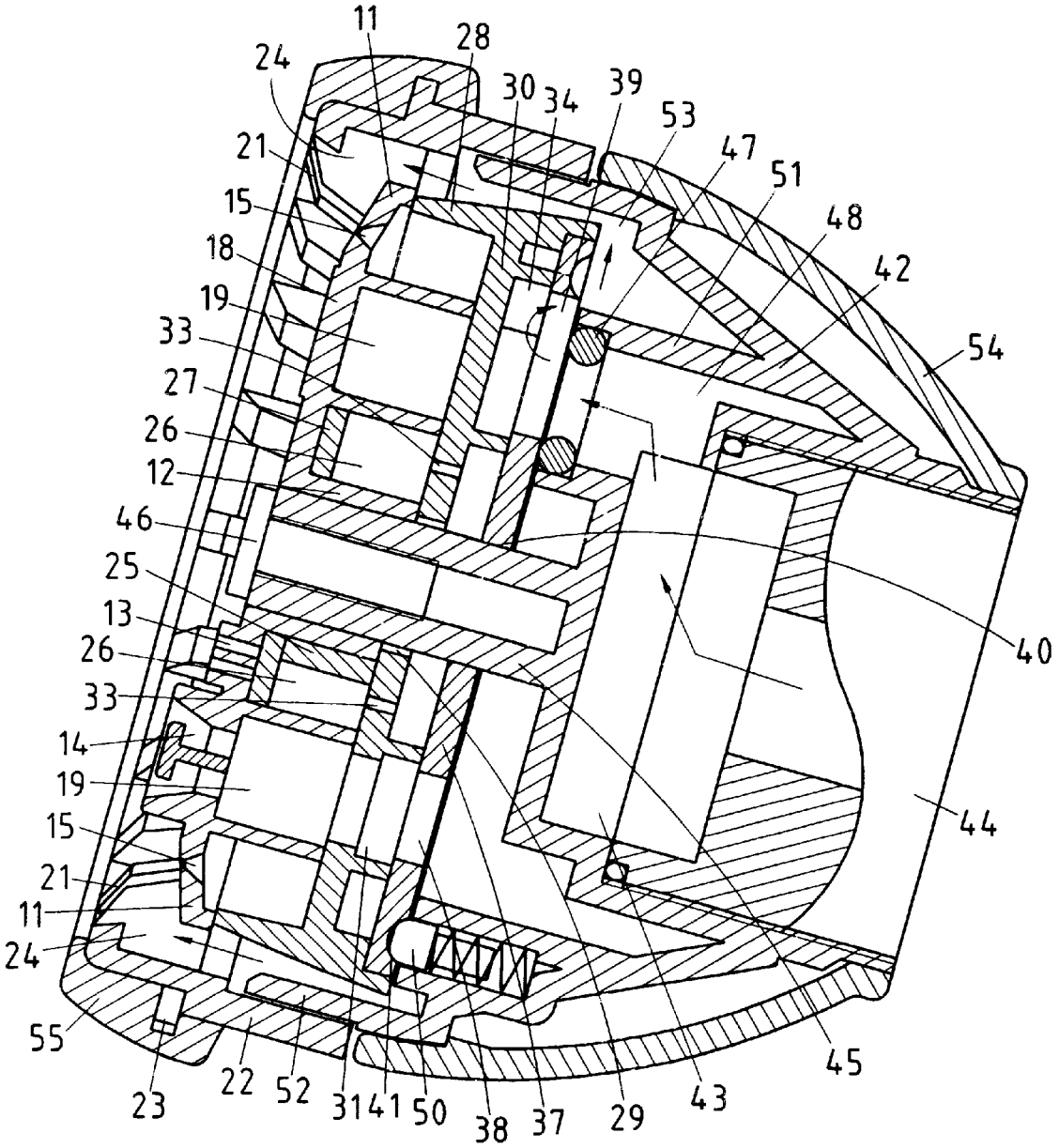
FIG. 7 shows a fourth sectional view of the present invention.

As shown in FIGS. 4, 5, 6, and 7, the water projecting structure of the present invention is designed to emit water in various ways. As shown in FIG. 4, a path of water flow includes the through holes 38 of the water distributing disk 37, the annular members 31, the guide tubes 19, and the inner water outlets 14, with one of the inner water outlets 14 communicating with the water tube 48. Now referring to FIG. 5, when the inner water outlet 14 is corresponding in location to the water tube 48, the water flow path includes one of the through holes 38, the annular member 31 having the indentation 32, the slanted through holes 33, the intervals of the lobes 26, and the pulsating water outlets 13. As shown in FIG. 6, when the outer water blocking member 17 is corresponding in location to the water tube 48, the water flow path traverses one of the through holes 38, one of the annular members 31, the guide tube 19 having the indentation 20, and the outer water outlets 15. As shown in FIG. 7, when the outer water blocking member 18 is corresponding in location to the water tube 48, the water flow path traverses the opening 39 of the water distributing disk 37, the frame surface 34 of the partition 30, the annular space 53 of the nozzle seat 42, and the water passages 24 located between the control ring 22 and the outer disk body 11.

The embodiment of the present invention described above is to be regarded in all respects as being merely illustrative, and not restrictive. Accordingly, the present invention may be embodied in other specific forms without deviating from the spirit thereof. The present invention is therefore to be limited only by the scope of the following appended claims.

What is claimed is:

1. A pistol-type sprayer apparatus comprising:

an outer disk body having a tubular member extending rearwardly therefrom, said outer disk body having a plurality of pulsating water outlets formed thereon, said outer disk body having a plurality of inner water outlets formed thereon, said outer disk body having a plurality of outer water outlets thereon, said outer disk body having a plurality of outer water blocking members formed thereon, said outer disk body having a plurality of guide tube extending rearwardly therefrom, one of said plurality of guide tubes having an indentation, said outer disk body having a plurality of ribs extending around a periphery of said outer disk body, said outer disk body having a control ring integral with said plurality of ribs, said control ring having protrusions extending outwardly therefrom, said outer disk body having plurality of water passages formed between said control ring and said periphery of said outer disk body;

a pulsating member rotatably mounted over said tubular member of said outer disk body, said pulsating member having a plurality of lobes formed thereon and extending from a flow stopping plate;

an inner disk body rotatably engaged with said outer disk body such that said pulsating member is interposed between said outer disk body and said inner disk body, said inner disk body having a partition extending thereacross, said partition having a plurality of annular members corresponding in location with said guide tube of said outer disk body, said inner disk body having a mounting hole corresponding in location to said tubular member of said outer disk body, said inner disk body having a plurality of slanted through holes formed on said partition, one of said plurality of annular members having an indentation thereon, said partition having a frame surface formed thereon;

a water distributing disk mounted over said tubular member of said outer disk body and against said inner disk body, said water distributing disk having a plurality of through holes arranged in a generally circular pattern, said water distributing disk having an opening formed thereon, said water distributing disk having a fitting hole located at a center of said water distributing disk, said fitting hole receiving said tubular member of said outer disk body therein, said water distributing disk having a plurality of locating recesses formed on a back surface thereof; and a nozzle seat having a convergence chamber therein, said nozzle seat having inner threads adapted to allow said nozzle seat to engage a barrel of a pistol-type sprayer, said nozzle seat having a pillar formed therein, said pillar having a threaded hole therein, said threaded hole receiving a fastening bolt therein, said nozzle seat having a water tube in communication with said convergence chamber, said nozzle seat having a guide tube formed therein, said guide tube of said nozzle seat having a biasing pin affixed thereto, said biasing pin exerting a pressure against at least one of said plurality of locating recesses, said nozzle seat having a sealing ring in sealing contact with a peripheral edge of said water distributing disk, said nozzle seat having a circular extension portion defining an annular space around a periphery of said inner disk body.

2. The apparatus of claim 1, said nozzle seat having a front shield affixed thereto and a rear shield affixed thereto.

* * * * *